US006035953A

United States Patent [19]

Rear

[11] Patent Number: 6,035,953

[45] Date of Patent: Mar. 14, 2000

[54] DOWN HOLE HAMMER ASSEMBLY

[76] Inventor: Ian Graeme Rear, 24 Hanwell Way, Bassendean, Western Australia, Australia

[21] Appl. No.: 08/973,986

[22] PCT Filed: Jun. 14, 1996

[86] PCT No.: PCT/AU96/00355

§ 371 Date: Jan. 15, 1998

§ 102(e) Date: Jan. 15, 1998

[87] PCT Pub. No.: WO97/00371

PCT Pub. Date: Jan. 3, 1997

[30] Foreign Application Priority Data

Jun. 15, 1995 [AU] Australia ..... 3579

[51] Int. Cl.[7] ..... E21B 4/06; E21B 7/20; E21B 10/36

[52] U.S. Cl. ..... 175/171; 175/415; 175/418; 175/320

[58] Field of Search ..... 175/415, 418, 175/414, 293, 296, 320, 321, 213, 402, 171

[56] References Cited

U.S. PATENT DOCUMENTS

| | | | |
|---|---|---|---|
| 3,732,143 | 5/1973 | Joosse | 175/6 |
| 4,031,970 | 6/1977 | Belknap . | |
| 4,921,052 | 5/1990 | Rear . | |
| 5,065,827 | 11/1991 | Meyers et al. | 175/414 |
| 5,085,285 | 2/1992 | Elsby et al. . | |
| 5,154,244 | 10/1992 | Elsby et al. | 175/296 |
| 5,168,942 | 12/1992 | Wydrinski | 175/50 |
| 5,271,472 | 12/1993 | Leturno | 175/107 |
| 5,472,057 | 12/1995 | Winfree | 175/57 |
| 5,511,628 | 4/1996 | Holte . | |
| 5,590,726 | 1/1997 | Jarvela et al. | 175/259 |
| 5,839,519 | 11/1998 | Spedale, Jr. | 175/57 |
| 5,845,722 | 12/1998 | Makohl et al. | 175/101 |

FOREIGN PATENT DOCUMENTS

| | | |
|---|---|---|
| 14114/76 | 11/1977 | Australia . |
| 52436/86 | 7/1987 | Australia . |
| 80143/87 | 4/1988 | Australia . |
| 72885/91 | 5/1991 | Australia . |
| 77559/91 | 10/1991 | Australia . |
| 55648/94 | 6/1994 | Australia . |
| 2854461 | 6/1980 | Germany . |
| 2243387 | 10/1991 | United Kingdom . |
| 2 286 002 | 8/1995 | United Kingdom . |

OTHER PUBLICATIONS

Derwent Abstract Accession No. 01968J/47, Class H01, SU,A, 899843 (SIDOROV N.F) Jan. 23, 1982.

*Primary Examiner*—David Bagnell
*Assistant Examiner*—Chong Cho
*Attorney, Agent, or Firm*—Ladas & Parry

[57] ABSTRACT

A down hole hammer assembly comprising a reverse circulation hammer (11) having a drill bit (12) mounted to one end of a housing which accommodates a percussive hammer, the other end of the housing being adapted to be mounted to a drill string, the assembly further comprising a support member (14) receivable on the lower end of a bore hole casing (13) which is receivable over the drill string, the support (14) comprising a first part (15) adapted to be fixed to the lower end of the casing and a second part (16) rotatably received on the first part (15) and capable of limited axial slidable movement thereon, the second part (16) being engagable with the drill bit (12) to be rotatable with the drill bit (12) on rotation of the drill bit (12) in one direction and to be movably axially with the drill bit (12) the drill bit (12) being disengagable with the second part (16) to be able to be movable axially relative to the second part (16), flow passageways being provided between the drill bit and the second part to deliver fluid to the cutting face and the drill bit being provided on its outermost axial face with at least one opening (33) to receive the fluid and entrained cuttings.

12 Claims, 4 Drawing Sheets

DOWN HOLE HAMMER ASSEMBLY

The present invention relates to a down hole hammer assembly.

BACKGROUND OF THE INVENTION

The invention of the present application has application in circumstances where it becomes necessary during a drilling operation to drill through generally loose material or unstable ground conditions such as overburden, alluvial ground or the like in which it is difficult to establish bore hole stability during the drilling operation. The difficulties that these sorts of conditions create is that as the drill penetrates through the ground, the hole can backfill behind the drill bit and jam the drill in position which not only prevents the drill from being withdrawn from the hole but also can prevent further penetration of the drill. In addition, there are circumstances when it becomes necessary to drill through such loose ground conditions and into the solid base below these ground conditions in order to provide an anchor for structures which may be located above the ground.

In each of the above circumstances referred to above, it is appropriate to introduce a casing down the hole in order to stabilise the ground conditions and/or enable the location of an anchor in the bottom of the bore hole. It is preferable to introduce the casing into the bore hole during the progress of the drilling operation however, this can be difficult in loose ground conditions due to the possibility of the bore hole collapsing and jamming the casing.

In previous arrangements where a down hole hammer is used in association with a casing the exhausted fluid from the hammer is returned to the surface between the casing and the exterior of the hammer and drill string and as a result of the velocity of the fluid flow the cuttings generated by the action of the hammer are entrained in the fluid flow. In some ground conditions however there is a likelihood that the cuttings can build up in the annular space between the casing and the hammer and/or drill string which can create blockages and/or cause the hammer to become jammed within the casing to prevent the rotation of the drill string within the casing. A further difficulty can arise when the drill assembly passes through loose or unstable ground conditions or in the event that the drill bit encounters a void. Under these conditions the exhausted fluid will tend to escape into the loose ground or voids around the casing which results in a significant loss of pressure. This loss of pressure in turn reduces the entrainment capacity of the fluid flow which will cause the outtings to build up in the region of the drill bit or around the exterior of the casing. As a result the drill bit or casing can become jammed in the hole which will prevent further penetration of the drill assembly and possibly retraction of the drill assembly from the hole.

It is an object of this invention to provide a means whereby the down the hole percussive hammer can be utilised with the bore hole casing to penetrate through unstable ground conditions and in which the exhausted fluid and entrained outings can be conducted to the surface through the hammer and the drill string rather than through the bore hole and/or the casing.

DISCLOSURE OF THE INVENTION

Accordingly, the invention resides in a down hole hammer assembly comprising a reverse circulation hammer having a drill bit mounted to one end of a housing which accommodates a percussive hammer, the other end of the housing being adapted to be mounted to a drill string, the assembly further comprising a support member receivable on the lower end of a bore hole casing which is receivable over the drill string, said support member comprising first part adapted to be fixed to the lower end of the casing and a second part rotatably received on the first part and capable of limited axial slidable movement thereon, said second part being engagable with the drill bit to be rotatable with the drill bit on rotation of the drill bit in one direction and to be movable axially with the drill bit, said drill bit being disengagable with the second part to be able to be movable axially relative to the second part, flow passageways being provided between the drill bit and the second part to deliver fluid to the cutting face and said drill bit being provided on its outermost axial face with at least one opening to receive the fluid and entrained cuttings for return to the surface through the hammer and drill string.

According to another form the invention resides in a drill bit assembly for a reverse circulation hammer adapted to be mounted to a drill string, the assembly further comprising a support member receivable on the lower end of a bore hole casing which is receivable over the drill string, said support member comprising a first part adapted to be fixed to the lower end of the casing and a second part rotatably received on the first part and capable of limited axial slidable movement thereon, said second part being engagable with the drill bit to be rotatable with the drill bit on rotation of the drill bit in one direction and to be movable axially with the drill bit, said drill bit being disengagable with the second part to be able to be movable axially relative to the second part, flow passageways being provided between the drill bit and the second part to deliver fluid to the cutting face and said drill bit being provided on tis outermost axial face with at least one opening to receive the fluid and entrained cuttings.

According to a preferred feature of both forms of the invention the second part has an outer axial face adapted to form an extension of the cutting face of the drill bit.

According to a further preferred feature of both forms of the invention a seal is provided between the support member and the reverse circulation hammer to prevent entry of fluid into the space between the casing and drill string.

According to a further preferred feature of both forms of the invention the second part is provided with one or more axial ribs at spaced intervals around its inner face and said drill bit is formed with an outer face of substantially complementary cross-section to enable relative movement of the drill bit past the second part and to provide overlapping portions which are selectively engagable when the second part is to be engaged with the drill bit. According to one embodiment the overlapping portions of the second part and the drill bit are formed with complementary splines and grooves whereby the overlapping portions can be interengaged on relative rotation in the one direction to limit the relative axial movement between the second part and the drill bit when so engaged and whereby when in such engagement the second part will rotate with the drill bit in the said one direction. In addition it is desired that on rotation of the drill bit relative to the second part, in a direction opposite to the one direction the overlapping portions can disengage.

The invention will be more fully understood in the light of the following description of one specific embodiment. The description is made with reference to the accompanying drawings of which:

DETAILED DESCRIPTION OF THE INVENTION

Figure 1:
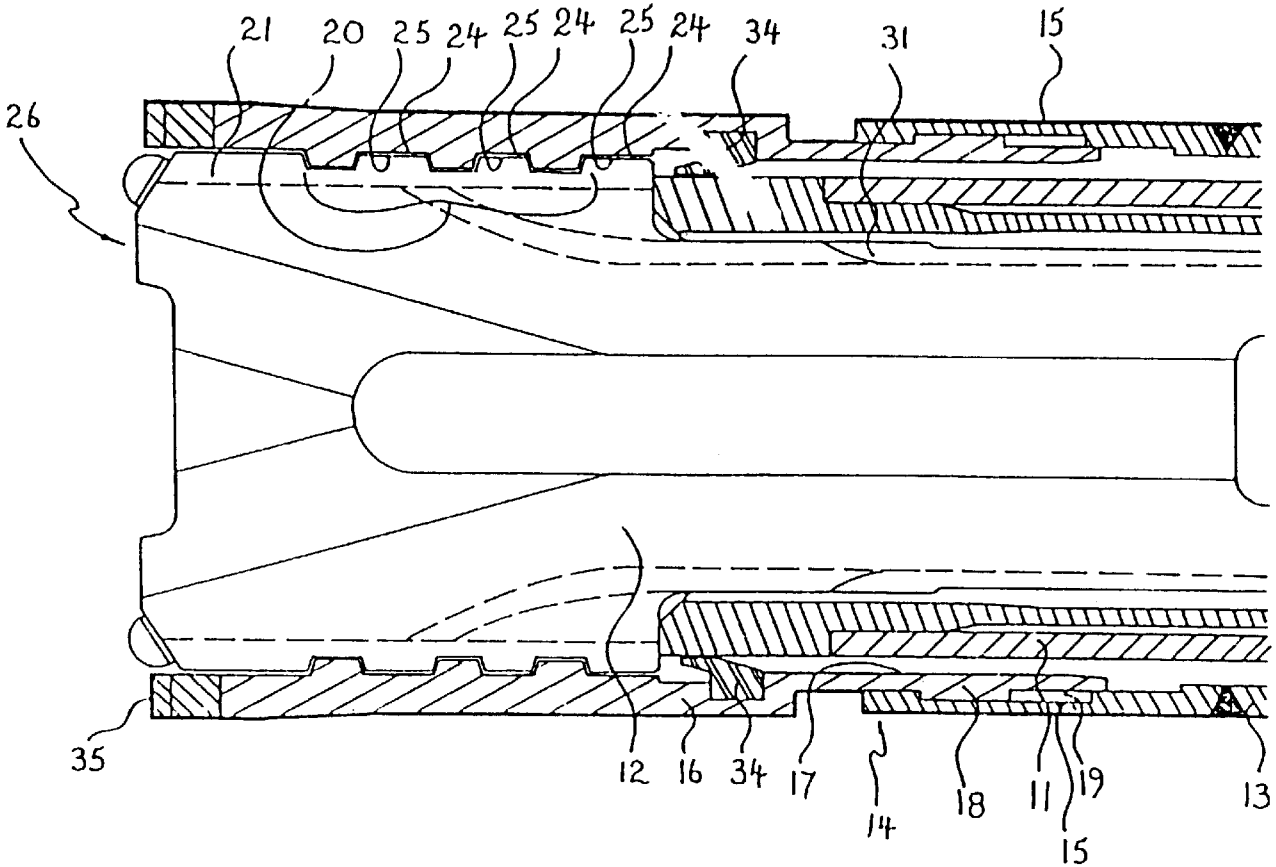
FIG. 1 is a sectional side elevation of the interconnection between the drill bit and support of the embodiment.
Figure 2:
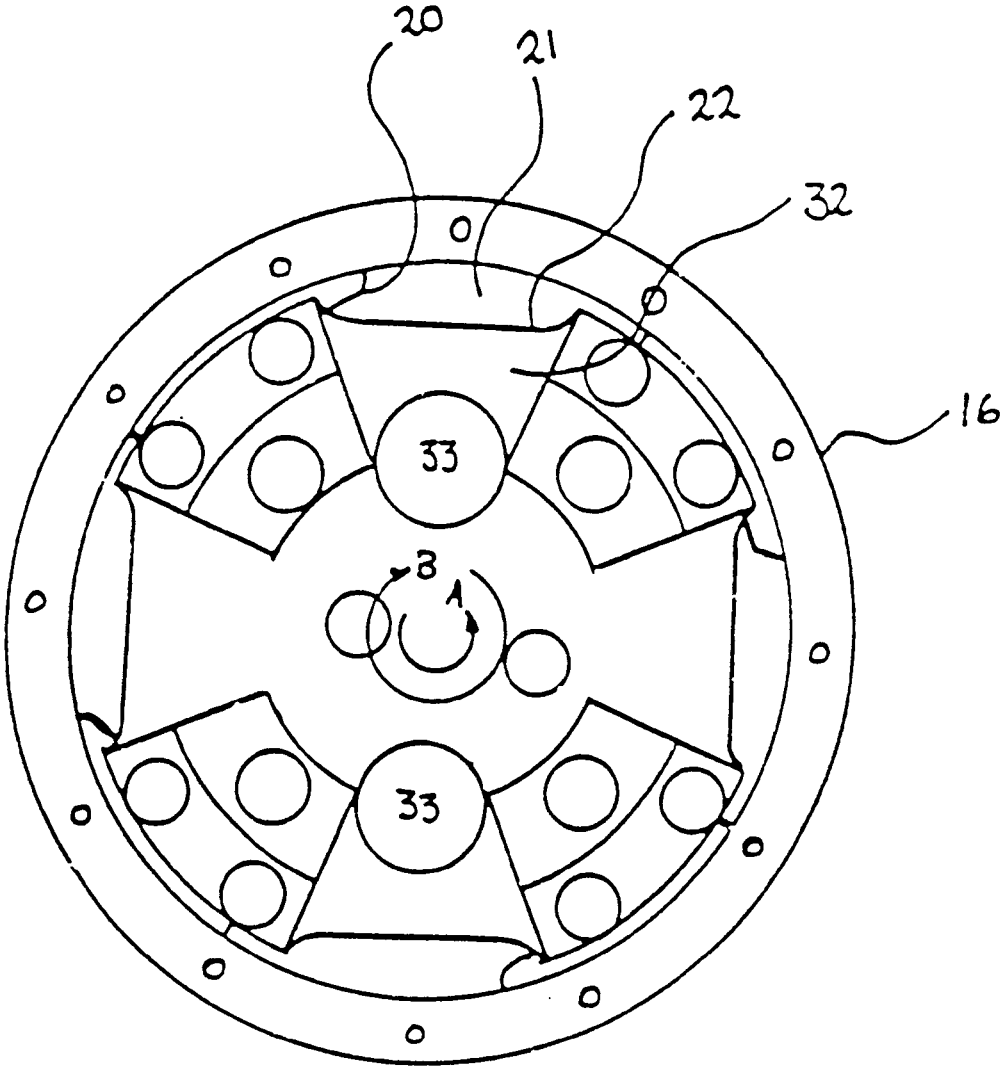
FIG. 2 is an end elevation of the embodiment of FIG. 1.

The embodiment is directed to a down hole hammer assembly which can be utilised with a casing for the purpose of both forming a borehole and at least partially lining the borehole with said casing.

The embodiment comprises a reverse circulation hammer 11 which supports a drill bit 12 at its lower end. The hammer 11 accommodates a percussive hammer (not shown) which can impact upon the inner end (not shown) of the drill bit 12 to provide an axial percussive force thereon. The hammer is in turn supported from a drill string (not shown). The hammer is associated with a borehole casing 13 through which the hammer and its associated drill string can pass.

The embodiment includes an interconnection provided between the hammer 11 and the casing 13 whereby in operation the casing 13 will move into the bore hole with the hammer and the hammer can provide assistance to the casing in its passage into the bore hole. This is effected by means of a support 14 which is mounted to the lower end of the casing 13 and can be engaged with the drill bit 12 of the hammer.

The support 14 comprises a first part 15 of generally annular cross-section which has the same outside diameter as the casing 13 and is welded in an end to end relationship therewith. The support 14 further comprises a second part 16 of generally annular cross-section which has an outside diameter a little greater than the outside diameter of the first part 15. The second part 16 is formed with an inner end portion 17 which is of a reduced external diameter to be slidably receivable within the first part 15. The inner end portion 17 is formed with an external rib 18 which is intermediate the length of the inner end portion 17 and is receivable in an internal recess 19 provided on the inner face of the first part 15. The axial dimension of the recess 19 is greater than the axial dimension of the rib 18 which enables the second part 16 to be capable of some relative axial slidable movement with respect to the first part 15 between two end positions. Furthermore, the interengagement of the external rib 18 on the inner end portion 17 of the second part 16 within the recess 19 of the first part 15 enables the second part 16 to be capable of relative rotation within the first part 15. To enable the fitting of the support member 14 to the casing 13, the first part 15 may be formed of two semi-circular sections which can be interengaged with each other when welded to the outer end of the casing 13 to entrap the second part 16 thereon.

The inner circumferential face of the second part 16 is provided with four angularly equidistant axial ribs 20 which provide between themselves four equally equidistant recesses 21. In addition, the external radial face of the drill bit is formed of a substantially complementary profile whereby it is provided with a set of four angularly equidistant flutes 22 which are of a cross-sectional profile generally corresponding to that of the ribs 20 of the second part 16. As a result, when the drill bit is located in the region of the second part of the ribs 20 of the second part are received in the flutes 22 of the drill bit, and as a result the drill bit when so positioned is capable of axial movement through the second part 16 whereby the hammer 11 is capable of outward axial movement with respect to the support 14 or inward axial movement with respect to the support 14.

Each of the ribs 20 in the second part are formed with a set of axially spaced circumferential grooves 24 which open to one side of the respective rib but are closed at the other side. In addition, each raised portion of the drill bit between each of the flutes 22 is formed as a set of part circumferential splines 25 of complementary profile to the grooves 24. As a result of some relative rotational movement between the overlapping portions of the drill bit and the second portion 16 which are of generally the same diameter and as defined by the ribs 20 of the second part 16 and the raised portions of the drill bit between the flutes 22 the overlapping portions can become interengaged whereby the splines 25 on the raised portions of the drill bit are received in the grooves 24 formed in the ribs 20 of the second part 16. In addition, since the grooves 24 are closed at one side of the ribs 20, the degree of rotation of the drill bit with respect to the second part 16 is limited. As a result, when the drill bit is turned in a counter-clockwise direction A in relation to the second part, the splines 25 thereon can become engaged with the grooves 24 of the second part 16. When the splines are fully engaged with the grooves the continued rotation of the drill bit will result in corresponding rotation of the second part 16. On relative rotation of the drill bit with respect to the second part in a counter-clockwise direction B, the ribs 25 of the drill bit can be moved out of engagement with the grooves 24 on the second part 16.

In order to facilitate accurate location of the drill bite within the second part 16 the grooves 24 and corresponding splines 25 are formed of differing widths whereby the drill bit can only become engaged with the second part 16 when the outer and of the second part 16 is in the vicinity of the cutting face 26 of the drill bit.

The outer axial end of the second part 16 is provided with additional cutting elements 35 whereby with rotation of the second part 16 on the drill bit 12 the additional cutting elements form an extension of a cutting face 26 of the drill bit.

To facilitate the engagement of the drill bit with the second portion 16 on axial movement of the drill bit towards either end of the second part the ribs 20 of the second part 16 and the raised portions of the drill bit are shaped in order that a driller on moving the drill bit into engagement with the second portion from either end thereof, can by controlled rotation of the drill bit sense the relative position of the drill bit within the second portion 16 thus be aware of the degree of engagement therebetween. This is effected by having a rebate on the inner axial face of each of the raised portions of the drill bit to provide an entry between the adjacent raised portions of which is of increased width compared to the flutes 22. In addition the inner axial face of the ribs 20 of the second part 16 is also be formed with a rebated portion to provide an entry between the ribs which is of increased width compared to the recesses 21 between the ribs. Through the rebates a driller on moving the drill bit into engagement with the second portion from either end thereof can by controlled rotation of the drill bit sense the relative position of the drill bit within the second portion 16 thus be aware of the degree of engagement therebetween.

In order to facilitate the clearance of cuttings from the cutting face 26 of the drill bit fluid passageways are provided between the drill bit 12 and the lower end of the hammer casing 32 by means of complementary axial splines therebetween, whereby fluid is delivered into the flutes 22 which are provided around the external face of the drill bit to be delivered into the region between the cutting face 26 of the drill bit and the axial face of the bore hole. To facilitate the flow of cuttings across the cutting face 26, radial grooves are provided across the cutting face 26. In addition, the inner portion of the cutting face of the drill bit 26 is formed with return passageways 33 which facilitate the return flow of cuttings and fluid to the surface.

To prevent the flow of fluid through the space between the casing 13 and the hammer 11, a annular seal 34 is provided on the inner face of the second part 16. The seal is formed of a suitably resilient material such that is capable of relative resilient deformation to facilitate movement of the drill bit downwardly through the casing past the seal 34.

In use the support 14 is applied to the end of the casing 13 and the casing is then introduced into a bore hole. The hammer can be subsequently introduced into the casing by passing the hammer and drill string down through the casing until the raised portions of the drill bit move past the seal 34 and become engaged with the inner axial face of the ribs 20 of the second part 16. With controlled rotation of the hammer with respect to the second part 16 the drill bit will become engaged with the spaced between the ribs 20. When the drill bits is in the desired position, relative rotation of the drill bit with respect to the second part in a counter-clockwise direction A will facilitate engagement of the splines 25 of the drill bit in the corresponding grooves 24 of the second part 16 whereby the drill bit 12 and second part 16 are interengaged to prevent relative axial movement therebetween.

Figure 3:
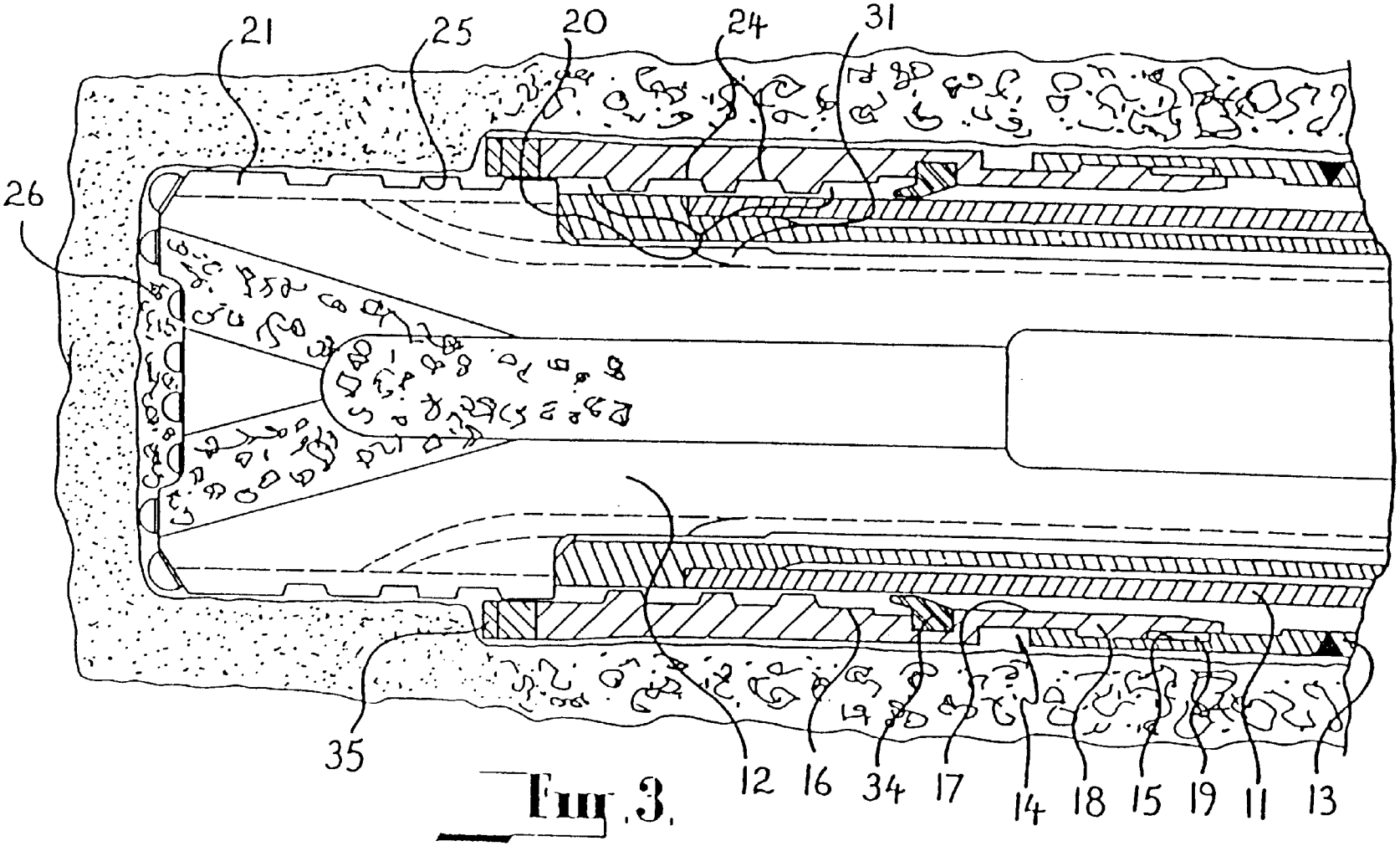
FIG. 3 is a side elevation of a hammer in use with the drill bit extending beyond the support.
Figure 4:
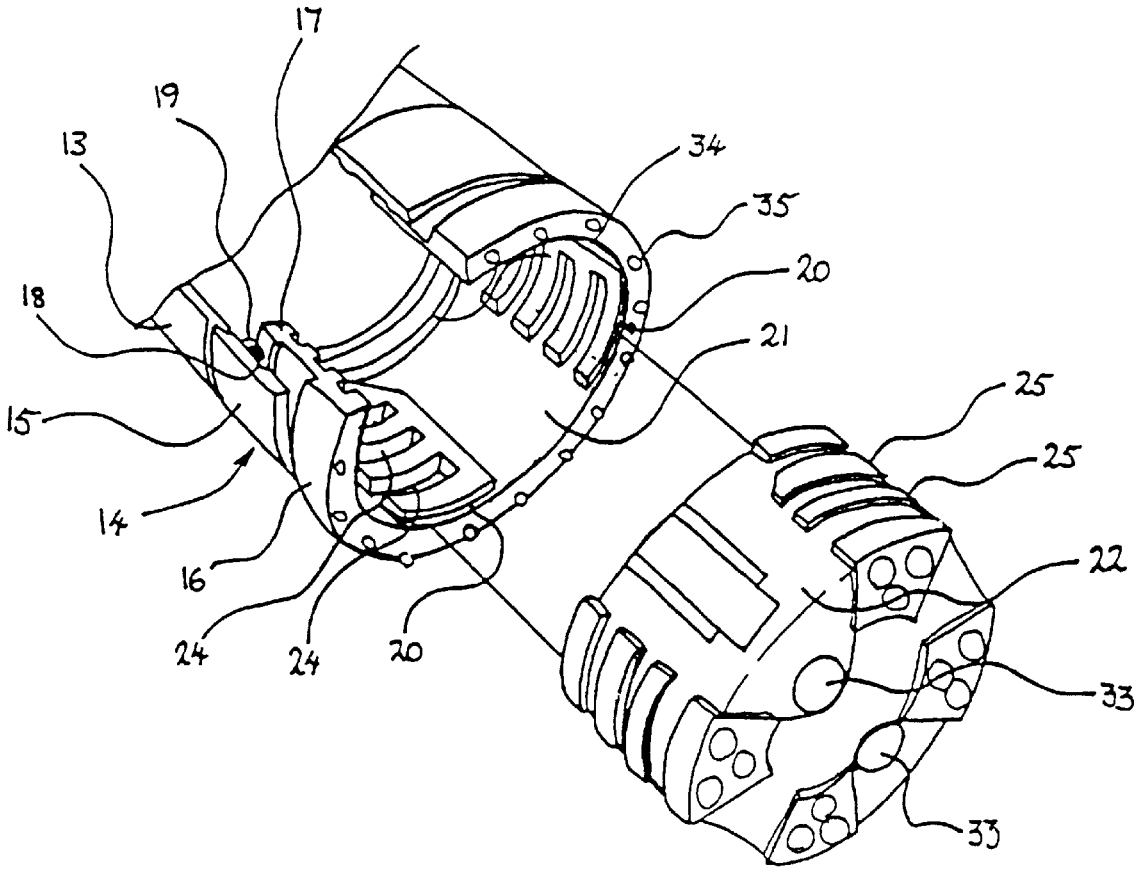
FIG. 4 is a schematic part exploded view of drill bit and support.

The drilling operation can then commence whereby the hammer is caused to rotate about the counter-clockwise direction A and in so doing the drill bit carries the second part 16 with it while the casing will move axially with the hammer but will not rotate with the drill bit. With progress of the hammer through the ground, the casing 13 will be either pulled downwardly with the hammer as a result of the transmission of impact forces on the drill bit to the first part of the support or will descend under its own weight as the hammer penetrates through the ground. This action will continue until the required depth of the casing has been achieved. This may be the time at which the unstable ground conditions have been penetrated from which position it may be decided that the bore hole is to be continued through the stable ground conditions which are to follow. If such a decision is made, the drill bit is turned in a clockwise direction B relation to the second part until the splines 25 are disengaged from the grooves 24 of the second part. At this time the hammer can then be reactivated and the drill bit will move past the second part 16 (as shown at FIG. 3). The bore hole is then continued to the desired depth and on achievement of the desired depth, the hammer can be withdrawn from the hole past the second part 16 and out of the casing.

The seal 34 between the second part 16 and the hammer is capable of resilient deformation to facilitate movement of the drill bit 12 downwardly past the seal without destruction of the seal, it may however suffer from some damage on withdrawal of the hammer out of the casing.

The present invention provides a means of selectively providing a unitary interconnection between the casing and a down hole hammer for the drilling of a bore hole through unstable ground conditions utilising the advantages which are available by means of a reverse circulation hammer whereby the cuttings are cleared from the cutting face without interfering between any surface between the casing and hammer.

It should be appreciated that the scope of the present invention need not be limited to the particular scope of the embodiment described above.

I claim:

1. A down hole hammer assembly comprising a reverse circulation hammer having a drill bit mounted to one end of a housing which accommodates a percussive hammer, the drill bit having a cutting face, the other end of the housing being adapted to be mounted to a drill string, the assembly further comprising a support member receivable on the lower end of a bore hole casing which is receivable on the lower end of a bore hole casing which is receivable over the drill string, said support member comprising a first part adapted to be fixed to the lower end of the casing and a second part rotatably received on the first part and capable of limited axial slidable movement thereon, said second part being engagable with the drill bit to be rotatable with the drill bit on rotation of the drill bit in one direction and to be movable axially with the drill bit, said drill bit being disengagable with the second part to be able to be movable axially relative to the second part, flow passageways being provided between the drill bit and the second part to deliver fluid to the cutting face and said drill bit being provided on its outermost axial face with at least one opening to receive the fluid and entrained cuttings for return to the surface through the hammer and drill string.

2. The down hole hammer assembly as claimed at claim 1 wherein, the second part has an outer axial face adapted to form an extension of the cutting face of the drill bit.

3. The down hole hammer assembly as claimed at claim 1 or 2 wherein, a seal is provided between the support member and the reverse circulation hammer to prevent entry of fluid into the space between the casing and drill string.

4. The down hole hammer assembly as claimed at anyone of the preceding claims wherein the second part is provided with one or more axial ribs at spaced intervals around its inner face and said drill bit is formed with an outer face of substantially complementary cross-section to enable relative movement of the drill bit past the second part and to provide overlapping portions which are selectively engagable when the second part is to be engaged with the drill bit.

5. The down hole hammer assembly as claimed at claim 4 wherein, the overlapping portions of the second part and the drill bit are formed with complementary splines and grooves whereby the overlapping portions can be interengaged on relative rotation in the one direction to limit the relative axial movement between the second part and the drill bit when so engaged and whereby when in such engagement the second part will rotate with the drill bit in said one direction.

6. A down hole hammer assembly as claimed at claim 5 wherein, on rotation of the drill bit relative to the second part, in a direction opposite to the one direction the overlapping portions can disengage.

7. A drill bit assembly for a reverse circulation hammer adapted to be mounted to a drill string, the assembly further comprising a support member receivable on the lower end of a bore hole casing which is receivable over the drill string, said support comprising a first part adapted to be fixed to the lower end of the casing and a second part rotatably received on the first part and capable of limited axial slidable movement thereon, said second part being engageable with the drill bit to be rotatable with the drill bit on rotation of the drill bit in one direction and to be movable axially with the drill bit, said drill bit being disengagable with the second part to be able to be movable axially relative to the second part, flow passageways being provided between the drill bit and the second part to deliver fluid to the cutting face and said drill bit being provided on its outermost axial face with at least one opening to receive the fluid and entrained cuttings for return to the surface through the hammer and drill string.

8. The drill bit assembly as claimed at claim 7 wherein, the second part has an outer axial face adapted to form an extension of the cutting face of the drill bit.

9. The drill bit assembly as claimed at claim 7 or 8 wherein, a seal is provided within the support member for engagement with the reverse circulation hammer to prevent entry of fluid into the space between the casing and drill string.

10. A drill bit assembly as claimed at claim 7 wherein the second part is provided with one or more axial ribs at spaced intervals around its inner face and said drill bit is formed with an outer face of substantially complementary cross-section to enable relative movement of the drill bit past the second part and to provide overlapping portions which are selectively engageable when the second part is to be engaged with the drill bit.

11. The drill bit assembly as claimed at claim 10 wherein, the overlapping portions of the second part and the drill bit are formed with complementary splines and grooves whereby the overlapping portions can be interengaged on relative rotation in the one direction to limit the relative axial movement between the second part and the drill bit when so engaged and whereby when in such engagement the second part will rotate with the drill bit in the said one direction.

12. A drill bit assembly as claimed at claim 11 wherein, on rotation of the drill bit relative to the second part, in a direction opposite to the one direction the overlapping portions can disengage.

* * * * *